United States Patent [19]

Bueters et al.

[11] Patent Number: 4,488,516

[45] Date of Patent: Dec. 18, 1984

[54] SOOT BLOWER SYSTEM

[75] Inventors: Kees A. Bueters, Enfield, Conn.; Mark S. Andersen, Port Huron, Mich.

[73] Assignee: Combustion Engineering, Inc., Windsor, Conn.

[21] Appl. No.: 553,015

[22] Filed: Nov. 18, 1983

[51] Int. Cl.[3] ..... F22B 37/18

[52] U.S. Cl. ..... 122/379; 122/392; 110/185

[58] Field of Search ..... 122/379, 381, 391, 390, 122/392, 395, 405; 110/185

[56] References Cited

U.S. PATENT DOCUMENTS

| | | | |
|---|---|---|---|
| 2,110,533 | 3/1938 | Snow et al. | 122/392 |
| 2,775,958 | 1/1957 | Kolling | 122/392 |
| 2,811,954 | 11/1957 | Hibner, Jr. et al. | 122/392 |
| 3,137,278 | 6/1964 | Cautieri et al. | 122/392 |
| 3,257,993 | 6/1966 | Kochey, Jr. | 122/392 |
| 3,269,366 | 8/1966 | Caracristi et al. | 122/392 |
| 3,274,979 | 9/1966 | Petit | 122/392 |
| 3,276,437 | 10/1966 | Jonakin et al. | 122/392 |
| 4,408,568 | 12/1983 | Wynnyckyj et al. | 122/379 |

*Primary Examiner*—Henry C. Yuen

*Attorney, Agent, or Firm*—William W. Habelt

[57] ABSTRACT

A soot blower system comprising a plurality of soot blowers (60) each of which is selectively operable to clean ash deposits (54) from the walls (12) of a furnace chamber (10) in direct response to the local heat transfer rate from the hot combustion products to the walls of the furnace sensed by one or more heat flux meters (62) mounted to the furnace wall in the general region surrounding each of the soot blowers.

2 Claims, 3 Drawing Figures

SOOT BLOWER SYSTEM

BACKGROUND OF THE INVENTION

The present invention relates to furnace wall soot blowers for cleaning ash deposits from the walls of the furnace of a fossil fuel fired steam generator and, more particularly, to a soot blower system for selectively operating individual soot blowers on an independent basis in response to the buildup of ash deposition on the furnace wall in the vicinity of each soot blower.

In steam generators wherein an ash bearing fossil fuel, such as coal, lignite or refuse, is burned, there has always been a problem associated with the deposition of ash formed in the combustion process and carried by the hot combustion products to the walls of the furnace. These ash deposits effectively act as insulation on the walls of the furnace thereby reducing heat transfer from the hot combustion products to the furnace walls which are typically formed of a series of laterally adjacent water cooled tubes welded together to form a gas type enclosure defining therein the combustion chamber of the furnace. As the water flows through these tubes it is heated by radiative heat transfer from the hot combustion products within the furnace to the tube walls of the furnace through which the water flows to generate steam.

As the amount of ash deposition on the furnace walls increases, the heat transfer to the furnace walls steadily decreases. Thus, when the furnaces are very clean as in the stages of initial operation, the heat transfer from the hot combustion products to the furnace wall tubes is very high and the temperature of the combustion products leaving the furnace is at a relatively low value. However, as the furnace walls become dirty from ash deposition, the heat transfer from the hot combustion products to the furnace wall tubes is significantly reduced and the temperature of the hot combustion products leaving the furnace significantly increased. This change in the heat balance over a period of operation of the furnace can cause significant problems for the operator in balancing steam generation. Therefore, it has become customary on furnaces firing ash bearing fossil fuels to install a plurality of soot blowers at various locations in the walls of the furnace over the heighth of the combustion chamber to intermittently clean the furnace walls. The soot blowers are well known in the art and typically involve spraying a blowing medium such as compressed air, water or steam from a spray nozzle head which is intermittently passed through an opening in the furnace wall into the furnace to direct the cleaning fluid under pressure against the surface of the ash deposit. The blowing medium causes thermal shock and high impact loading on the ash deposit thus causing the ash deposit to fall from the furnace wall thereby resulting in a relatively clean furnace tube again being exposed to the hot combustion products.

The deposition of ash on the furnace walls is not uniform over the height of the furnace walls or even over the width of the furnace walls. Certain areas of the furnace tend to receive rapid high ash deposition while other areas of the furnace receive very low ash deposition and remain relatively clean. It is extremely difficult, if not impossible, to predict the exact ash deposition profile which will occur in any given furnace firing any given fossil fuel. Thus, it has become customary to provide a control system for operating the soot blowers of the furnace in an automatic mode, usually according to a preselected time sequence. Each of the individual soot blowers would be operated, typically a row at a time, at set time intervals based upon operating experience. Such a control system is not always entirely satisfactory as relatively clean areas of the furnace may be blown too frequently causing excessive tube wear and unnecessary and expensive use of soot blowing medium while dirty areas of the furnace may be blown too infrequently thereby never achieving a relatively clean furnace condition in those areas. Thus, there is a need for a soot blower system wherein the furnace wall surrounding each soot blower is cleaned selectively as needed.

One scheme for operating soot blowers on a selective basis is disclosed in U.S. Pat. No. 3,276,437. As disclosed therein, each soot blower is operated selectively to clean the furnace wall associated with each soot blower in response to the local furnace wall temperature. Thermocouples are welded to the furnace wall tubes in the vicinity of each soot blower to sense the actual surface temperature of the furnace wall. These wall temperatures are then compared to a set point temperature calculated to be representative of a dirty furnace condition at the particular saturation temperature of the water flowing through the water cooled tubes of the furnace wall. When the sensed temperatures in any one zone fall below this set point temperature, the soot blower associated with that zone is activated. In this manner, the various soot blowers are activated to clean the zones of the furnace with which they are associated in response to furnace dirtiness.

However, furnace wall temperature is not always an adequate measurement of furnace dirtiness. The wall temperature at any particular point on the furnace wall depends on the saturation temperature of the fluid flowing through the water wall tubes. Unfortunately, the local fluid saturation temperature varies with elevation and also with the presence of subcooling at the water wall fluid entrance. Thus, it is very difficult to obtain a true fluid saturation temperature for calculating the preset temperature indicative of furnace dirtiness. Further, on a supercritical steam generator wherein a mixture of water and steam is passed through the tubes at a pressure above the supercritical point of water, there is no way of calculating or determining the metal temperature which would be indicative of furnace dirtiness as metal temperature will vary significantly over the height of the unit dependent not only on the local heat flux but also on the phase state of the mixture flowing through the tubes at that location which is an unknown. Therefore, the control system disclosed in U.S. Pat. No. 3,276,437 would not perform satisfactorily on a furnace of a supercritical steam generator.

It is therefore, an object of the present invention to provide a soot blower system for selectively cleaning the tube walls of the furnace in response to the local heat transfer rate and not local wall temperature.

It is a further object to provide a means for indicating the need for soot blowing in the general area of the furnace wall surrounding a particular soot blower.

SUMMARY OF THE INVENTION

In accordance with the present invention, a plurality of soot blowers are disposed in spaced locations in the furnace walls with each soot blower adapted when activated to clean a particular region of the furnace wall surrounding it. Means for sensing the local heat transfer rate from the combustion products to the furnace walls is located in each of the regions of a furnace wall surrounding each of the soot blowers. Means are provided for comparing each of the sensed local heat transfer rates to a preselected lower set point value of heat transfer rate and for generating an output whenever the sensed local heat transfer rate is less than the lower value set point. The lower value set point of heat transfer rate is selected to be indicative of the heat transfer rate which would be expected for a furnace wall covered with a maximum acceptable ash deposition. The output generated by the comparison means would activate indicating means in the control room to alert the operator of the dirty furnace condition. Alternatively, the output generated by the comparison means would automatically activate the soot blower associated with that furnace wall region.

Additionally, means may be provided for comparing each of the sensed local heat transfer rates to a preselected upper value of set point of the heat transfer rate and for generating an output whenever the sensed local heat transfer rate is greater than the upper value set point. The upper value set point would be indicative of an acceptable clean condition of the furnace wall. When the sensed local heat transfer rate is greater than the upper value set point, the output generated by the comparison means would deactivate the indicating means located in the control room which indicates a dirty furnace condition.

Preferably, the means for sensing the local heat transfer rate comprises a heat flux meter mounted directly to the furnace wall on the combustion chamber side of the furnace wall. Additionally, it is preferred that display means be provided in the control room for indicating the relative position thereon of each of the plurality of soot blowers and of each of the plurality of heat flux meters disposed about the soot blowers. The display means has first indication means for indicating the operational status of each of the soot blowers and second indication means for indicating the relative output of each of the heat flux meters.

DESCRIPTION OF THE PREFERRED EMBODIMENT

Figure 1:
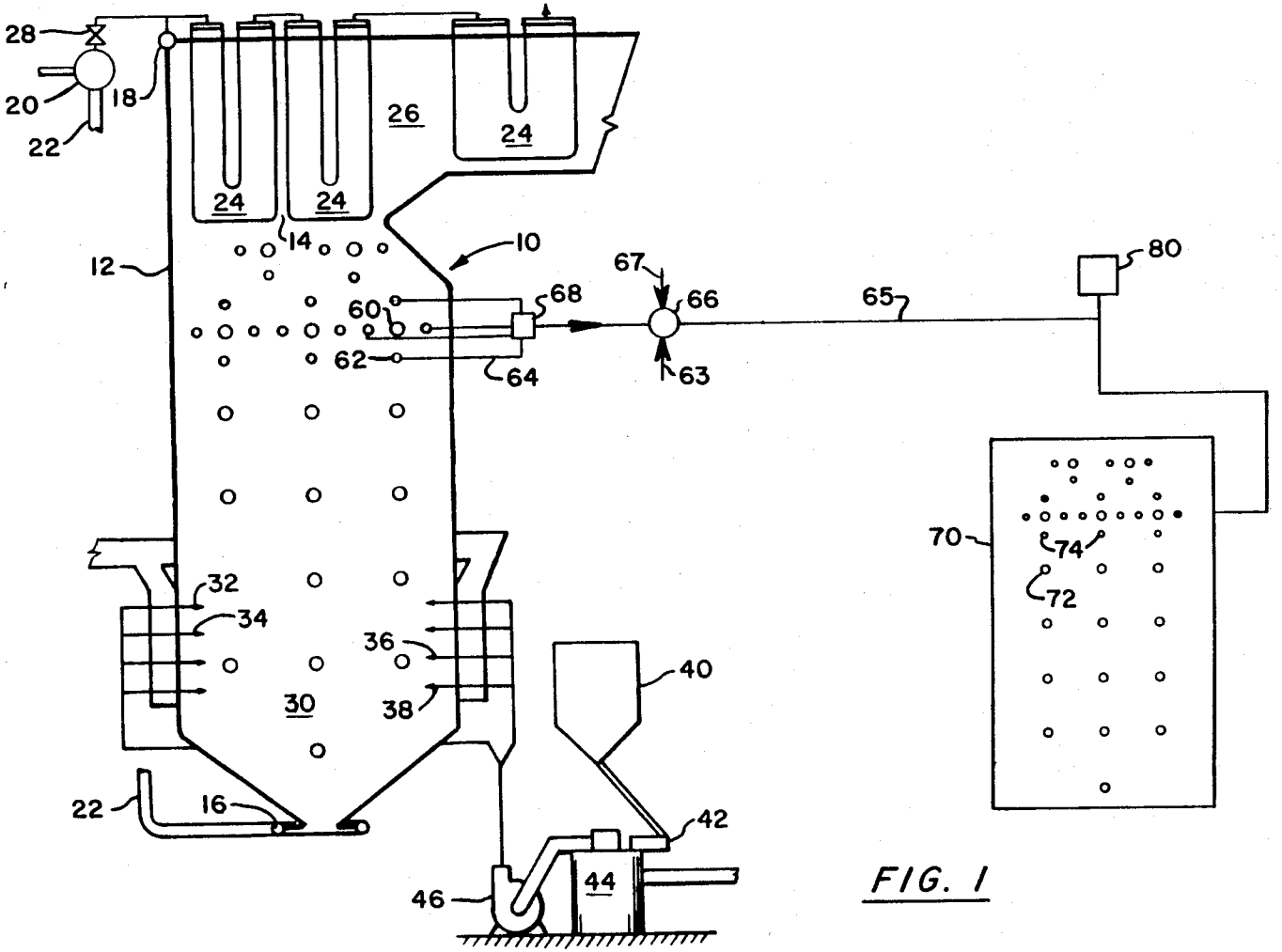
FIG. 1 is a sectional side elevation view of a furnace wall of a steam generator and a display panel associated therewith illustrating the application of the present invention.

Referring now to FIG. 1, there is depicted therein a fossil fuel-fired supercritical steam generator having a vertically elongated furnace 10 formed of upright water walls 12 and a gas outlet 14 located at the upper end thereof. To generate steam, water is passed at supercritical pressure through the lower water wall inlet header 16 upwardly through the water walls 12 forming the furnace 10. As the water passes upwardly through the water walls 12, it absorbs heat from the combustion of a fossil fuel within the furnace 10 and is evaporated to form steam. The steam leaving the water wall 12 is collected in an outlet header 18 and is then passed through heat exchange surface 24, such as a superheater or reheater, disposed in the gas exit duct 26 connected to the furnace outlet 14 for conveying the hot combustion products formed in the furnace to the steam generator stack. In passing through the heat exchange surface 24, the steam is superheated as it is passed in heat exchange relationship with the hot gases leaving the gas outlet 14 of the furnace 10. During startup, a portion of the steam generated in the water walls 12 is passed from the outlet header 18 through valve 28 to mixing header 20 wherein the steam is mixed with feed water from the economizer and passed through downcomer 22 to the lower water wall header 16.

The furnace 10 is fired by injecting ash-bearing fossil fuel, such as coal, into the furnace in a combustion zone 30 through several fuel burners 32, 34, 36 and 38 located in the lower region of the furnace 10 remote from the gas outlet 14 thereof. The amount of fuel injected into the furnace is controlled to provide the necessary total heat release to yield a desired total heat absorption in the furnace walls for a given steam generator design. All coal is fed from a storage bin 40 at a controlled rate through feeder 42 to an airswept pulverizer 44 wherein the raw coal is pulverized to a small particle size. Preheated air is drawn by an exhauster fan 46 through the pulverizer 44 wherein the comminuted coal is entrained in and dried by the preheated airstream. The comminuted coal and air is then fed to the combustion zone 30 of the furnace 10 through the burners 32, 34, 36 and 38.

Figure 2:
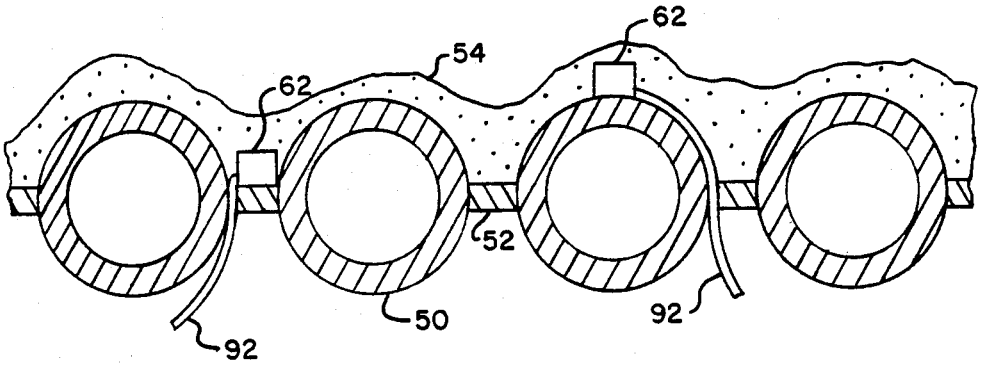
FIG. 2 is a section through a portion of the furnace tube wall showing heat sensing means of the present invention installed on the furnace wall with the furnace wall being covered with an ash deposit.

As seen in FIG. 2, the furnace walls 12 are formed of a series of laterally adjacent water-cooled tubes 50 disposed side by side and welded together by webs 52. Alternatively, the tubes could be disposed tangent to each other and merely interconnected by welding rather than by welding a web 52 between the tubes 50 as shown in FIG. 2. As the ash bearing fuel is combusted in the combustion chamber 30 of the furnace 10, ash particles are formed which are carried by the hot combustion products to the surface of the water wall tubes 50. When the hot ash particles entrained in the combustion products contact the tubes 50, the ash sticks to the coal tube resulting in an ash deposit 54, typically termed slag, builds up on the surface of the water cooled tubes 50 lining the furnace 10.

As this ash deposit 54 builds up on the surface of the water cooled tubes 50 of the furnace wall 12, the transfer of heat from the hot combustion products, primarily by radiation, to the water cooled tubes 12 is significantly reduced and the temperature of the hot combustion products leaving the furnace 10 at the outlet 14 has significantly increased. This results in the total heat absorption by the furnace walls 12 decreasing and the heat absorption by the steam generating surface 24 increasing. Typically, the furnace 10 is designed to operate with the heat absorption by the furnace walls 12 and the heat absorption by the steam generating surface 24 to be proportioned within certain limits. As the furnace walls 12 become coated with a heavy ash deposition, the proportioning of the heat absorption between the furnace walls 12 and the steam generating surface 24 may fall outside of the acceptable range and the temperature of the hot combustion products leaving the furnace outlet 14 become too excessive. Therefore, it is necessary to intermittently clean the ash deposits 54 from the water cooled tubes 50 of the furnace walls 12 in order to return the furnace wall heat absorption to a higher acceptable level.

In order to clean the furnace walls 12, a plurality of soot blowers 60 are disposed at various locations across the width and the heighth of the furnace water wall 12 to remove the ash deposits 54 therefrom when the soot flowers are activated. Each soot blower typically comprises a spray head, not shown, which may be passed into the furnace chamber through an appropriate opening in a water cooled tube 50 forming the furnace wall 12 to impinge a stream of a high pressure blowing medium, such as air, steam or water, against the surface of the ash deposit 54. The impact of the blowing medium against the ash deposit 54 causes a thermal shock in the hot ash deposit and a hiqh impact loading which results in the ash deposit 54 disloding from the water cooled tubes 50 and dropping to the bottom of the furnace where it is removed through an ash collection system, not shown, disposed beneath the furnace. It is to be understood that the exact details of the particular soot blower 60 utilized is not germaine to the present invention and further details of the soot blowers 60 are not deemed necessary to provide an understanding of the present invention.

In accordance with the present invention, at least one heat transfer rate sensing means 62 is operatively associated with each soot blower 60 and is mounted to the furnace wall 12 in a location in the region to be cleaned by the soot blower 60 in which it is associated. Preferably, three or four heat transfer rate sensors 62 are operatively associated with each soot blower 60. The heat transfer sensing means 62 senses the local heat transfer rates in the hot combustion products to the water cooled tube wall 50 in each of the regions of the tube wall surrounding one of the plurality of soot blower 60. As shown in FIG. 2, the heat transfer sensing means 62 is mounted to the furnace wall 12 on the furnace side thereof and is preferably mounted to the crown of the water cooled tubes 50, but may also be mounted to the web 52 between adjacent water cooled tubes 50. In either case, the heat transfer rate sensing means is covered with an ash deposit 54 as are the water cooled tubes 50 and therefore reflects a heat transfer rate which would be substantially representative of that incident upon the water cooled tubes 50.

Further in accordance with the present invention, as shown in FIG. 1, comparison means 66 is provided for comparing each of the sensed local heat transfer rates to a preselected lower set point value 63 of the heat transfer rate and for generating an output whenever the sensed local heat transfer rate is less than the lower value set point 63 for heat transfer rate. Comparison means 66 would receive a signal 64 from each of the heat flux sensing means 62 associated with the soot blower 60 and compare the sensed heat transfer rates to the lower set point value 63 which would be indicative of a minimally acceptable heat transfer rate. It is to be understood that the lower set point value 63 could be varied for each soot blower 60 disposed on the furnace water wall 12 to reflect the acceptable minimum heat transfer rate for that particular elevation and location on the furnace wall 12. If desired, rather than transmitting all of the sensed heat transfer rates from a multiplicity of heat transfer rate sensing means 62 associated with a particular soot blower 60 directly to the comparison means 66, a controller 68 may be interdisposed between comparison means 66 and the sensing means 62 to receive the sensed heat transfer rates signal 64 and then transmit a single signal to the comparison means 66 which is indicative of the average value of the local heat transfer rates signal 64 transmitted by the sensing means 62 associated with the soot blower 60.

Whenever the sensed local heat transfer rate is less than the lower set point value 63, the comparison means 66 generates an output signal 65 which is transmitted to display means 70. Display means 70 is provided, typically in the control room of the steam generator plant, for indicating the relative position thereon of each of the plurality of soot blowers 60 and each of the plurality of heat transfer rate sensing means 62 associated with each of the soot blower 60. The display means 70 has first indication means 72 for indicating the operational status of each of the soot blowers 60 and second indication means 74 for indicating the output status of each of the heat transfer rate sensing means 62. For example, the indicating means 72 and 74 could be lights which would be activated in response to the output signal 65 from the comparison means 66 for each of the soot blowers 60. Upon receipt of an output signal 65 from the comparison means 66, each of the second indication light means 74 corresponding to the sensing means 62 from which the heat transfer rate signal is regenerated would be lit to indicate to the operator that the furnace wall in that region has become excessively dirty. Upon activation of the soot blower 60 the first indication light means 72 associated therewith would light up to indicate the operational status of that soot blower.

Preferably, the comparison means 66 would also compare the sensed heat transfer rate 64 from each of the heat transfer rates sensing means 62 to a preselected upper value set point 67 of heat transfer rate and generate an output signal 65 whenever the sensed local heat transfer rate is greater than the upper set point value. The upper set point value 67 would be indicative of the local heat transfer rate expected under acceptable clean furnace conditions for the region of the furnace wall in which the sensing means 62 are located. In response to the signal 65, the second indication light means 74 on the display means 70 on the control room would be turned off thereby indicating to the operator that the portion of the furnace wall associated with the heat transfer sensing means 62 was now clean. The operator could then deactivate the soot blower 60 and the first indication light means 72 associated therewith would also be extinguished.

It is further contemplated by the present invention to provide control means 80 for selectively activating and deactivating each soot blower independently in response to the signal 65 from the comparison means 66. Control means 80 would be responsive to comparison means 66 to selectively activate each soot blower independently whenever the comparison means 66 indicated that the sensed local heat transfer rate in the region cleaned by the soot blower 60 is less than the lower value set point 63. Additionally, the control means 80 would be responsive to the comparison means 66 for selectively deactivating each activated soot blower whenever the comparison means indicates that the sensed local heat transfer rate in the region cleaned by the soot blower has reached a value greater than the upper value set point 67 thereby indicating that the furnace wall in that region has been returned to a clean condition.

Figure 3:
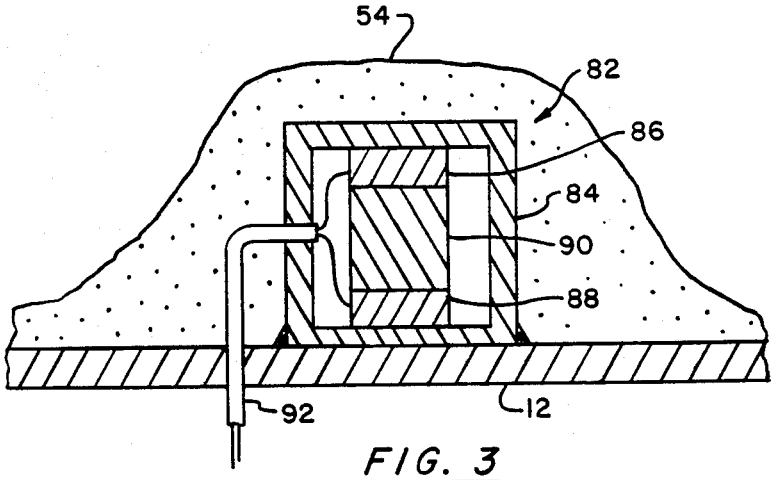
FIG. 3 is a detailed cross-sectional view of a heat flux meter installed on the furnace wall.

In the best mode presently contemplated for carrying out the invention, the heat transfer sensing means 62 comprises a heat flux meter 82 as shown in FIG. 3. The heat flux meter 82 is well known in the art and comprises a housing 84 mounted to the furnace wall 12 and enclosing therein two thermalcouple leads 86 and 88 spaced apart from each other in direction of heat flow by material 90. The hot thermocouple lead 86 would sense a first temperature, and the cold thermocouple lead 88 a second temperature which would be lower than the first temperature due to the presence of the insulating material 90 therebetween. The difference in temperatures between the thermocouple leads 86 and 88 would be indicated as a voltage difference across the leads of the cable 92 which are attached one to the thermocouple 86 and one to the thermocouple 88. This voltage differential signal 64 would pass through lead 92 to the comparison means 66. This voltage signal 64 would be a direct indication of the local heat transfer rate passing from the hot combustion products through the ash deposit 54 into the furnace wall 12.

The present invention has provided therefore a means of selectively controlling the soot flowers on a fossil fuel fired furnace wherein the soot blowers are activated in direct response to the sensed heat transfer rate impinging upon the furnace walls rather than on a secondary indication of the heat transfer rate such as wall temperature. The soot blower system of the present invention is therefore particularly applicable to supercritical coal-fired steam generators wherein the metal temperature of the water cooled tubes 50 forming the furnace walls 12 cannot be directly related in any fashion to local heat transfer rate. Since the soot blower system of the present invention responds directly to the actually sensed heat transfer rate, the soot blower system of the present invention is applicable not only to subcritical but also to supercritical steam generator furnaces.

We claim:

1. A soot blower system for selectively cleaning ash deposits from the walls of a furnace chamber wherein the walls are formed of a series of laterally adjacent fluid-cooled tubes and wherein an ash-bearing fuel is combusted to generate hot combustion products which transfer heat to the fluid-cooled tube walls of said furnace chamber; said soot blower system comprising:

a. a plurality of soot blowers disposed at spaced locations in the fluid-cooled tube walls of said furnace chamber, each soot blower adapted when activated to clean a region of the tube wall surrounding it;

b. a plurality of heat flux meters associated with said plurality of soot blowers for sensing the local heat transfer rate from the hot combustion products to the tube walls, at least one heat flux meter located in each cleaning region associated with each of said plurality of soot blowers;

c. display means for indicating the relative position thereon of each of said plurality of soot blowers and each of said plurality of heat flux meters; said display means having first indication means for indicating the operational status of each of said soot blowers and second indication means for indicating the output of each of said heat flux meters;

d. first comparison means for comparing the local heat transfer rate sensed by each of said plurality of heat flux meters to a preselected lower value set point of heat transfer rate and generating an output for activating the second indication means associated with each heat flux meter for which the sensed local heat transfer rate is less than the preselected lower value set point; and e. second comparison means for comparing the local heat transfer rate sensed by each of said plurality of heat flux meters to a preselected upper value set point of heat transfer rate and generating an output for deactivating the second indication means associated with each heat flux meter for which the sensed local heat transfer rate is greater than the preselected upper value set point.

2. A soot blower system as recited in claim 1 wherein the preselected lower value and upper value set points of heat transfer rate to which the local heat transfer rate sensed by each heat flux meter is compared vary as a function of the location of the heat flux meter of the tube walls of said furnace chamber.

* * * * *